US006243904B1

(12) United States Patent
Kubota et al.

(10) Patent No.: US 6,243,904 B1
(45) Date of Patent: Jun. 12, 2001

(54) APPARATUS FOR CLEANING PHOTO FILM

(75) Inventors: Masayuki Kubota; Yuzo Tsunekawa, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/598,923

(22) Filed: Jun. 22, 2000

Related U.S. Application Data

(62) Division of application No. 09/405,071, filed on Sep. 27, 1999, now abandoned, which is a division of application No. 08/794,015, filed on Feb. 3, 1997, now Pat. No. 5,991,954.

(30) Foreign Application Priority Data

Feb. 5, 1996 (JP) ..... 8-019059

(51) Int. Cl.[7] ..... B08B 1/02; B08B 11/00
(52) U.S. Cl. ..... 15/100; 15/102
(58) Field of Search ..... 15/100, 102, 308, 15/309.1

(56) References Cited

U.S. PATENT DOCUMENTS

| | | | |
|---|---|---|---|
| 1,487,375 | 3/1924 | Fuchs | 15/100 |
| 1,623,528 | 4/1927 | De Moos | 15/100 X |
| 1,927,284 | 9/1933 | Howell | 15/100 |
| 1,949,868 | 3/1934 | Keuffel | 15/100 |
| 3,019,464 | 2/1962 | Grunwald et al. | 15/100 |
| 3,346,898 | 10/1967 | Stella et al. | 15/100 |
| 3,641,605 | 2/1972 | Lindsay | 15/308 X |
| 3,644,953 | 2/1972 | Christiansen | 15/100 X |
| 3,945,079 | 3/1976 | Westberg | 15/100 |
| 4,116,762 | 9/1978 | Gardiner | 15/309.1 X |
| 4,145,231 | 3/1979 | Heckman | 134/9 |
| 4,213,222 | 7/1980 | Schoettle et al. | 15/100 |
| 4,832,275 | 5/1989 | Robertson | 242/348.3 |
| 4,832,772 | 5/1989 | Noguchi et al. | 15/100 X |
| 4,834,306 | 5/1989 | Robertson et al. | 242/348.3 |
| 4,858,265 | 8/1989 | Suzuki et al. | 15/100 |
| 5,271,577 | 12/1993 | Takahashi et al. | 242/348.3 |

FOREIGN PATENT DOCUMENTS

| | | |
|---|---|---|
| 40 26 616 | 2/1992 | (DE) . |
| 1 282 375 | 7/1972 | (GB) . |
| 1 453 600 | 10/1976 | (GB) . |

OTHER PUBLICATIONS

Database WPI Week 9541 Derwent Publications Ltd., London, GB, AN 95–31543 XP002030440 & jp 07 212 650 A (Fuji Photo Film Co Ltd) Aug. 11, 1995 *abstract.

*Primary Examiner*—Mark Spisich
(74) *Attorney, Agent, or Firm*—Sughrue, Mion, Zinn, Macpeak & Seas, PLLC

(57) ABSTRACT

A method of, and an apparatus for, cleaning a web of photo film during the manufacture is disclosed wherein the web of photo film is transported in its lengthwise direction, and a cleaning tape made of felt is pressed onto an entire area or a side portion of a surface of the photo film or a side edge of the photo film, while the photo film and the cleaning tape are transported in opposite directions.

7 Claims, 7 Drawing Sheets

APPARATUS FOR CLEANING PHOTO FILM

This is a divisional of application Ser. No. 09/405,071 filed Sep. 27, 1999, abandoned, which is a divisional of U.S. application Ser. No. 08/794,015 filed Feb. 3, 1997, now U.S. Pat. No. 5,991,954, the disclosure of which is incorporated herein by reference.

BACKGROUND OF THE INVENTION

1. Field of the Invention

The present invention relates to a method of, and an apparatus for, cleaning photo film, especially for photo film having a magnetic recording layer on a reverse surface to an emulsion surface. More particularly, the present invention relates to a method of, and an apparatus for, cleaning photo film during the manufacture.

2. Background Arts

A new type photo film cartridge has been developed and disclosed, for example, in U.S. Pat. Nos. 4,834,306 and 4,832,275, and JPA 3-37645 (U.S. Pat. No. 5,271,577), wherein an entire length of photo filmstrip is wound into a cartridge shell before and after use, and a film leader is advanced out of the cartridge shell in response to an unwinding rotation of a spool of the cartridge shell. This new type photo film cartridge is easy to load in the camera, easy to handle and thus improves work efficiency during the photograhic processing.

It is also known in the art to provide a transparent magnetic recording layer on the new type photo filmstrip so that photographic data or print data may be magnetically recorded on the photo filmstrip in association with respective frames. When manufacturing the photo filmstrip, an emulsion layer is applied on an obverse surface of a wider web of base film, and the magnetic layer is applied on a reverse surface of the wider web. Thereafter, the wider web is slit into narrower webs of a constant width. The narrower web is perforated and cut into individual filmstrips of predetermined lengths, each of which is then wound into the cartridge shell.

As a result of the slitting, particles of film or swarf are produced from the cut edges of the narrower webs. The film swarf and dust floating in the factory can be put on the photo filmstrip. If the swarf and dust are put on the magnetic recording layer, the swarf and dust accumulate on a magnetic head, thereby deteriorating sensitivity of the head and the signal frequency characteristics. This may result in writing errors or reading errors. The swarf or dust on the emulsion surface results in black spots in the images exposed on the photo filmstrip. The swarf or dust on either surface can result in black spots in the photo-prints since the printing light transmits through the photo filmstrip.

SUMMARY OF THE INVENTION

In view of the foregoing, an object of the present invention is to provide a method of cleaning photo film from dust or swarf produced during the manufacture, and an apparatus therefor.

To achieve the above object, the present invention provides the steps of transporting a web of photo film in a lengthwise direction, transporting a continuous cleaning tape in a direction parallel to the lengthwise direction of the photo film, and pressing the cleaning tape on one surface of the photo film while the cleaning tape and the photo film are transported.

As the emulsion surface is to record image frames, it is very important not to scratch the frame recording area of the emulsion surface. To ensure protection against the scratches on the frame recording area by the cleaning, it is preferable not to clean the frame recording area. For this cleaning method, a pair of cleaning tapes are pressed onto side portions of the emulsion surface outside the frame recording area, while transporting the cleaning tapes in a direction parallel to the lengthwise direction of the photo film.

To clean side edges of the photo film, a pair of cleaning tapes are pressed onto the side edges, while transporting the cleaning tapes in a direction parallel to the lengthwise direction of the photo film.

BRIEF DESCRIPTION OF THE DRAWINGS

The above and other objects and advantages of the present invention will become apparent from the following detailed description of the preferred embodiments when read in connection with the accompanying drawings, which are given by way of illustration only and thus are not limitative of the present invention, wherein like reference numerals designate like or corresponding parts throughout the several views, and wherein.

DETAILED DESCRIPTION OF THE PREFERRED EMBODIMENT

Figure 1:
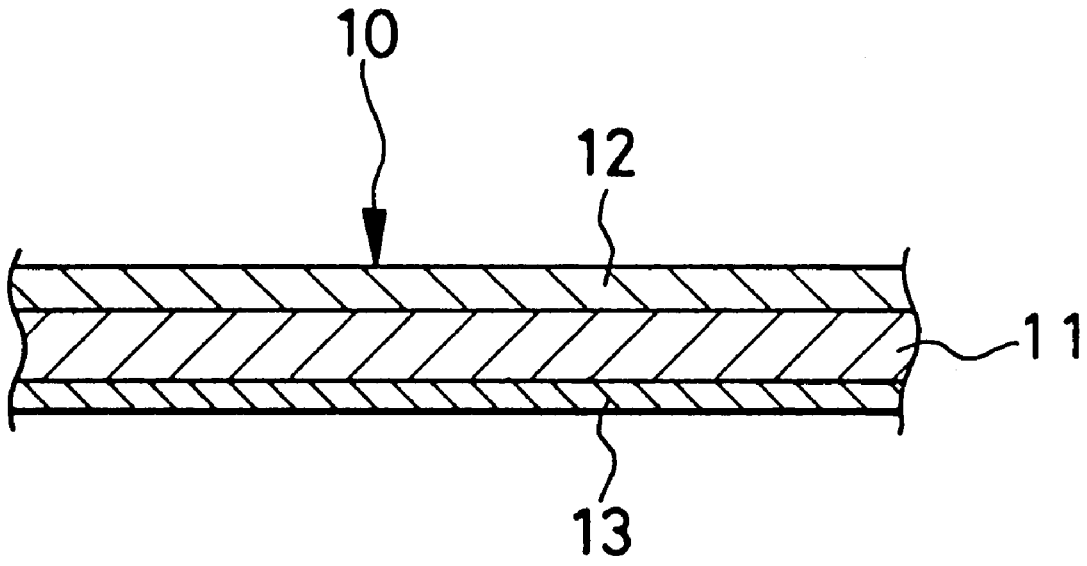
FIG. 1 is an explanatory sectional view of photo film having a magnetic recording layer.

As shown in FIG. 1, the new type photo film 10 is constituted of a base film 11, a photosensitive emulsion layer 12 and a transparent magnetic layer 13. The emulsion layer 12 and the magnetic layer 13 are applied on the opposite surfaces of the base film 11. The magnetic layer 13 permits recording photographic data or print data thereon through a magnetic head provided in a camera, a film inspector, a printer or the like.

Figure 2:
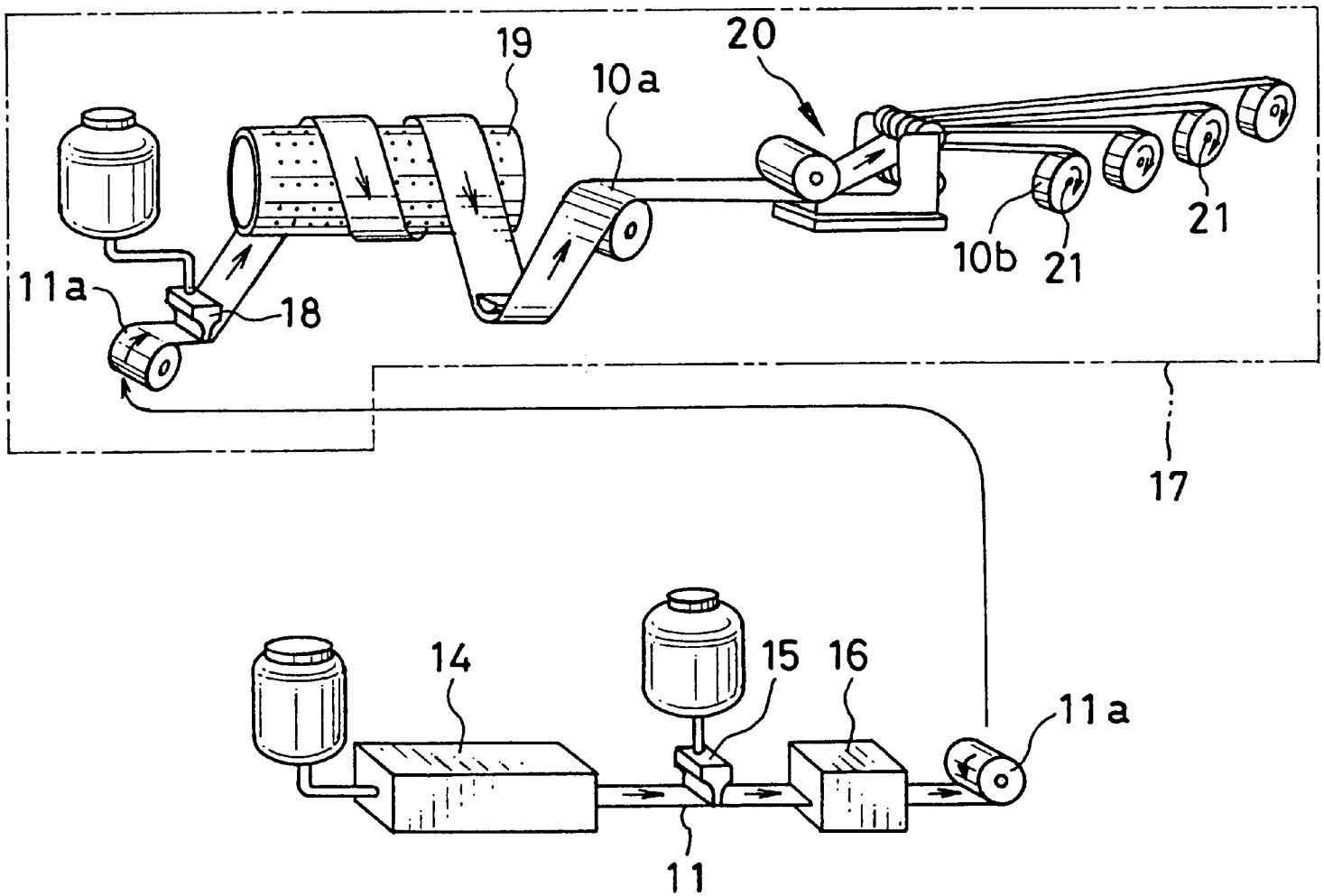
FIG. 2 is an explanatory view of the first stage of a film manufacturing line.

The base film 11 is formed from a transparent synthetic resin material, e.g., cellulose triacetate (TAC), polyethylene terephthalate (PET) and annealed polyethylene naphthalate (A-PEN). Referring to FIG. 2, in a base film producer 14, the material is melded or solved to be formed into a highly transparent web 11 having a constant thickness and a larger width than photo filmstrips to be manufactured.

While the web of base film 11 is transported in a lengthwise direction at a constant speed, a magnetic layer coating device 15 coats one surface of the base film 11 with the magnetic layer 13 of a constant thickness. After being coated with the magnetic layer 13 and dried through a drier 16, the web of base film 11 is coiled into a roll 11*a*. The roll 11*a* of base film 11 is sent to a photosensitive emulsion applying process 17 which is executed in a dark room. The base film 11 is withdrawn from the roll 11*a*, and transported at a constant speed through an emulsion coating device 18, which applies the emulsion layer 12 on the other surface of the base film 11 from the magnetic layer 13. As well known in the art, the emulsion layer 12 is constituted of many coats of different kinds emulsions which vary depending upon the film type such as the film speed, the discrimination between the negative and the positive or between color film or black-and-white film. After the emulsion layer 12 is dried through a drier 19, a wider web 10*a* of photo film is transported to a slitter 20. The slitter 20 slits the wider web 10*a* into a plurality of webs 10*b* of a predetermined width. The webs 10*b* of photo film are wound up around respective reels 21.

Figure 3:
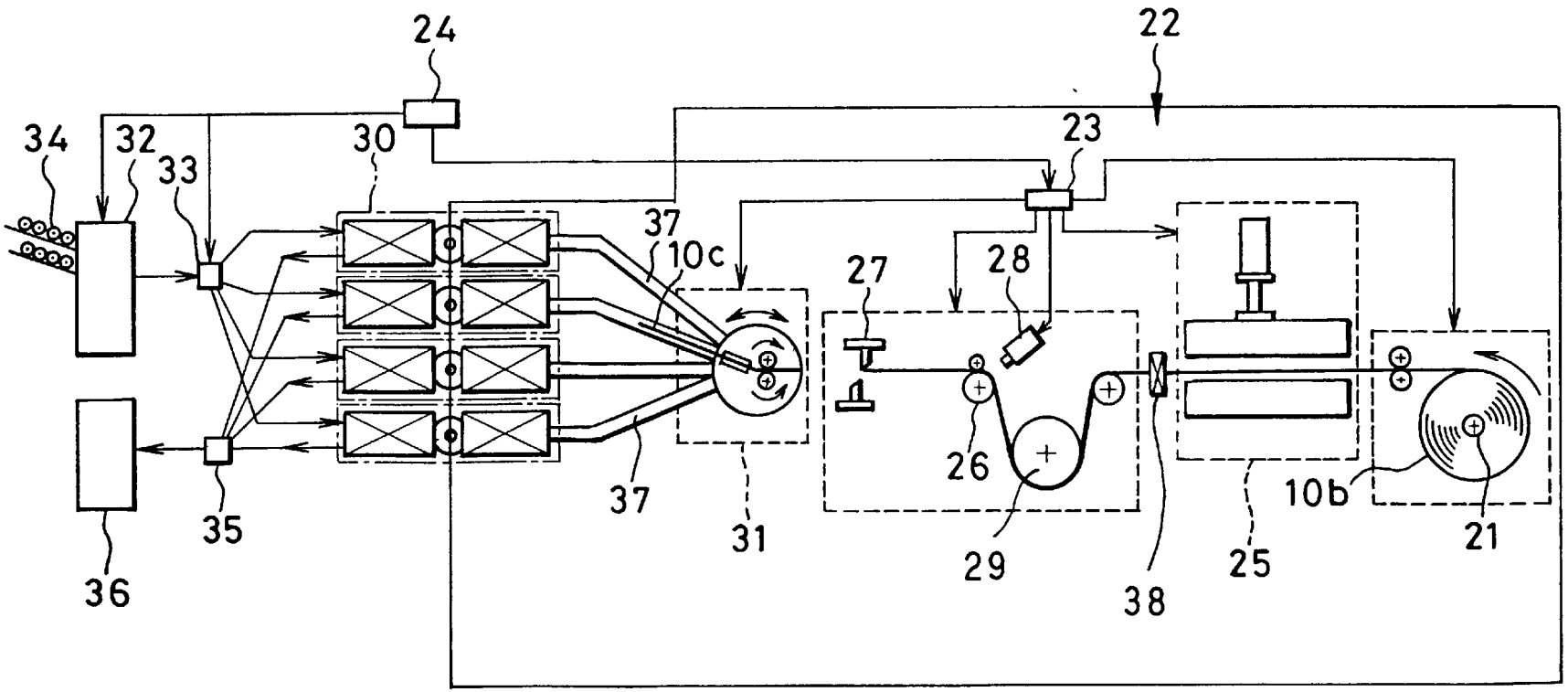
FIG. 3 is an explanatory view of the last stage of the film manufacturing line including a film cleaning process according to the invention.

The reel 21 with the photo film web 10*b* is sent to a film cartridge manufacturing process 22, as shown in FIG. 3. A process controller 23 controls the film cartridge manufacturing process 22 such that the photo film web 10*b* is formed into individual photo filmstrips 10*c* in accordance with a film size which is entered through a size input device 24. The film size includes the number of available exposures in addition to the above mentioned film type, since the length of the individual filmstrip varies depending upon the available exposure number.

The photo film web 10*b* is transported from the reel 21 to a perforator 25 through a not-shown accumulator or buffer, because the photo film web 10*b* intermittently pauses for a while the perforator 25 forms a series of perforations along a limited length of the photo film web 10*b*, so it is necessary to absorb the speed difference between the intermittent transportation through the perforator 25 and the supply from the reel 21. The length of making a series of perforations at one time is determined according to the film size. After being perforated, the photo film web 10*b* is transported by a suction drum 29 to a measuring feeder 26. The measuring feeder 26 transport the photo film web 10*b* by a length that is also determined according to the film size.

Then a trimmer 27 cuts the photo film web 10*b* into the filmstrip 10*c* of a length defined by the film size. The measuring feeder 26 may be a suction drum. While the photo film web 10*b* is transported by the measuring feeder 26, a side printer 28 prints latent images of film size code, frame serial numbers, and ID code representative of a manufacture number or the like on one or both sides of the photo film web 10*b*. The trimmer 27 simultaneously shapes a trailing end of the filmstrip 10*c* made presently, and a leading end of a filmstrip to be made next, in the transporting direction of the photo film web 10*b*. In this embodiment, the leading end of each filmstrip 10*c* in the transporting direction is provided with holes to secure the filmstrip to a spool of each cartridge shell, though the holes are not shown in the drawings. In other words, the trailing end of each filmstrip 10*c* in the transporting direction will be a leader when the filmstrip 10*c* is coiled into a cartridge shell 34 in a film winding device 30.

There are a plurality of film winding devices 30, and a film distributer 31 distributes the filmstrips 10*c* seriatim to the respective film winding devices 30 through passageways 37, to permit concurrently winding a plurality of filmstrips 10*c*. The cartridge shells 34 are supplied to the film winding device 30 from a cartridge supplier 32 through a cartridge distributer 33. Each cartridge shell 34 is provided with the same ID code as one of the filmstrips 10*c* has as the latent image. The film distributer 31 and the cartridge distributer 33 are controlled such that those filmstrip 10*c* and cartridge shell 34 having the same ID code are set in the same film winding device 30. The film winding device 30 collates the ID code of the filmstrip 10*c* with that of the cartridge shell 34 and, if the ID codes are identical, winds the filmstrip 10*c* into the cartridge shell 34. Subsequent photo film cartridges are aligned in a line at a junction 35, to be sent to a shipment process 36.

As described above, the film winding device 30 secures the filmstrip 10*c* to the spool of the cartridge shell at the leading end in the transporting direction, and winds the filmstrip 10*c* into the cartridge shell 34 until the trailing end is entirely located inside the cartridge shell 34. The trailing end, i.e. the leader, of the filmstrip 10*c* is advanced to the outside of the cartridge shell 34 when the spool is rotated in an unwinding direction.

In the embodiment shown in FIG. 3, a film cleaning apparatus 38 according to the invention is disposed behind the perforator 25 before the suction drum 29. Thereby the swarf or chips produced by perforating are reliably put away from the photo film 10*b*. However, since the continuous web of photo film 10*b* is transported intermittently through the perforator 25, cleaning during the intermittent transportation can result in unevenness. Therefore it is desirable to dispose an accumulator or a loop between the perforator 25 and the cleaning apparatus 38, so as to permit transporting the photo film 10*b* continuously at a constant speed through the cleaning apparatus 38. It is alternatively possible to locate the cleaning apparatus 38 behind the reel 21 before the not-shown accumulator, where the photo film 10*b* is supplied from the reel 21 at a constant speed. It is also possible to locate the cleaning step after the slitting step by the slitter 20 before winding the photo film 10*b* on the reels 21. The film cleaning apparatus 38 is constituted of three cleaning devices for cleaning the magnetic layer surface 13, the emulsion surface 12, and opposite side edges of the filmstrip 10*c*. Each cleaning device uses a cleaning tape or tapes to wipe off the dust and swarf.

Figure 4:
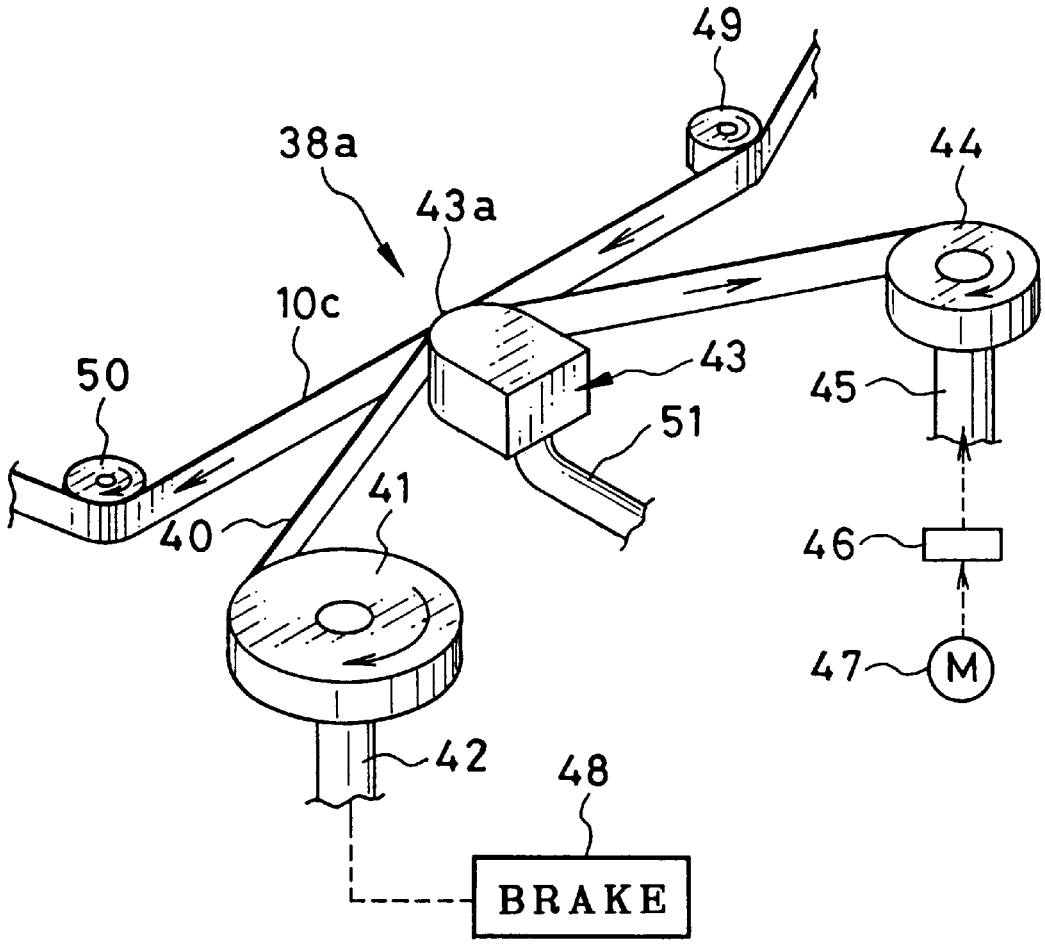
FIG. 4 is a perspective view of a first type cleaning device according to an embodiment of the invention, for cleaning an entire area of a surface of the photo film.

FIG. 4 shows a first type 38*a* of the three cleaning devices that cleans the entire magnetic layer surface 12. The cleaning device 38*a* uses a cleaning tape 40 having a width equal to or wider than the filmstrip 10*c*. The cleaning tape 40 is wound around a supply reel 41, and the reel 41 is fit on a driven shaft 42. The cleaning tape 41 is wound up onto a take-up reel 44 through a cleaning head 43. The take-up reel 44 is fit on a drive shaft 45 which is rotated by a motor 47 through a speed reduction device 46. A brake 48 is coupled to the driven shaft 42 to prevent the cleaning tape 40 from loosening. The cleaning head 43 has a semi-cylindrical contour, and the cleaning tape 40 slides on a convex face surface 43*a* of the cleaning head 43. The cleaning head 43 gently presses the cleaning tape 40 onto the magnetic layer surface 13 of the filmstrip 10*c* while the filmstrip 10*c* is transported from a guide roller 49 to a guide roller 50.

The cleaning tape 40 and the filmstrip 10*c* are transported in the opposite directions in the embodiment shown in FIG. 4. It is possible to transport them in the same direction. In that case, however, the dust wiped off the filmstrip 10*c* can transfer from the used cleaning tape 40 back to the filmstrip 10*c* due to the static electricity on the filmstrip 10*c*, especially when the used cleaning tape 40 faces the magnetic layer surface 13. Therefore, it is preferable to transport the cleaning tape 40 in the opposite direction to the transporting direction of the filmstrip 10*c*.

The cleaning tape 40 is preferably made of felt. Beside that, super fine fibers having a trademark TORECY (TORAY CO.) or synthetic leather having a trademark ECSANE (TORAY CO.) is preferable as the material for the cleaning tape 40, as the least scratching materials to the photo film 10.

According to the results of experiments, the transporting speed of the cleaning tape 40 is preferably 1 cm/minute when the transporting speed of the filmstrip 10*c* is 200 m/minute. If the cleaning tape 40 is transported too fast, the efficiency of the cleaning tape 40 is lowered. If the cleaning tape 40 is transported too slow, the wiping will be insufficient.

It is preferable to spray the filmstrip 10*c* with anionic or cationic atmosphere before wiping it, so as to eliminate static electricity charged on the dust. Then, the dust becomes easy to wipe out. Also, it is preferable to support the cleaning head 43 through a cushioning medium such as a spring, for cushioning the pressure from the cleaning head 43 onto the filmstrip 10*c* to ensure protection against the scratch on the filmstrip 10*c*.

Figure 5:
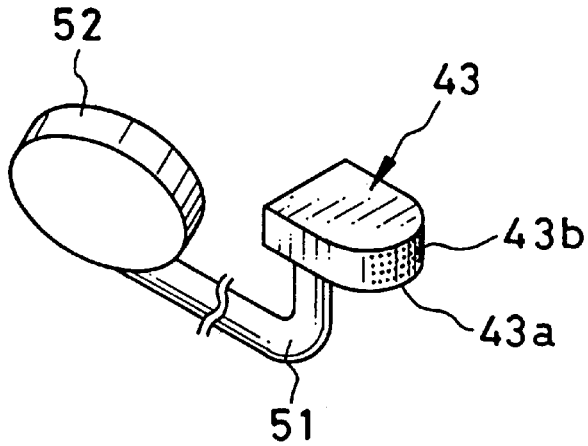
FIG. 5 is a perspective view of a cleaning head of the first type cleaning device.

By using a porous material, e.g. the felt, as the material of the cleaning tape 40, and sucking the dust from the rear side of the cleaning tape 40, the dust is prevented from transferring back to the photo film 10. For this purpose, the cleaning head 43 has a lot of small holes 43*b* formed through the convex face surface 43*a* that is pressed onto the cleaning tape 40, as shown in FIG. 5. The holes 43*b* are connected to a suction device 52 through a pipe 51. By virtue of the suction of the suction device 52 through the holes 43*b* and the pores of the cleaning tape 40, the dust wiped off the filmstrip 10*c* is sucked up by the cleaning tape 40 or absorbed into the suction device 52 through the pipe 51.

Figure 6:
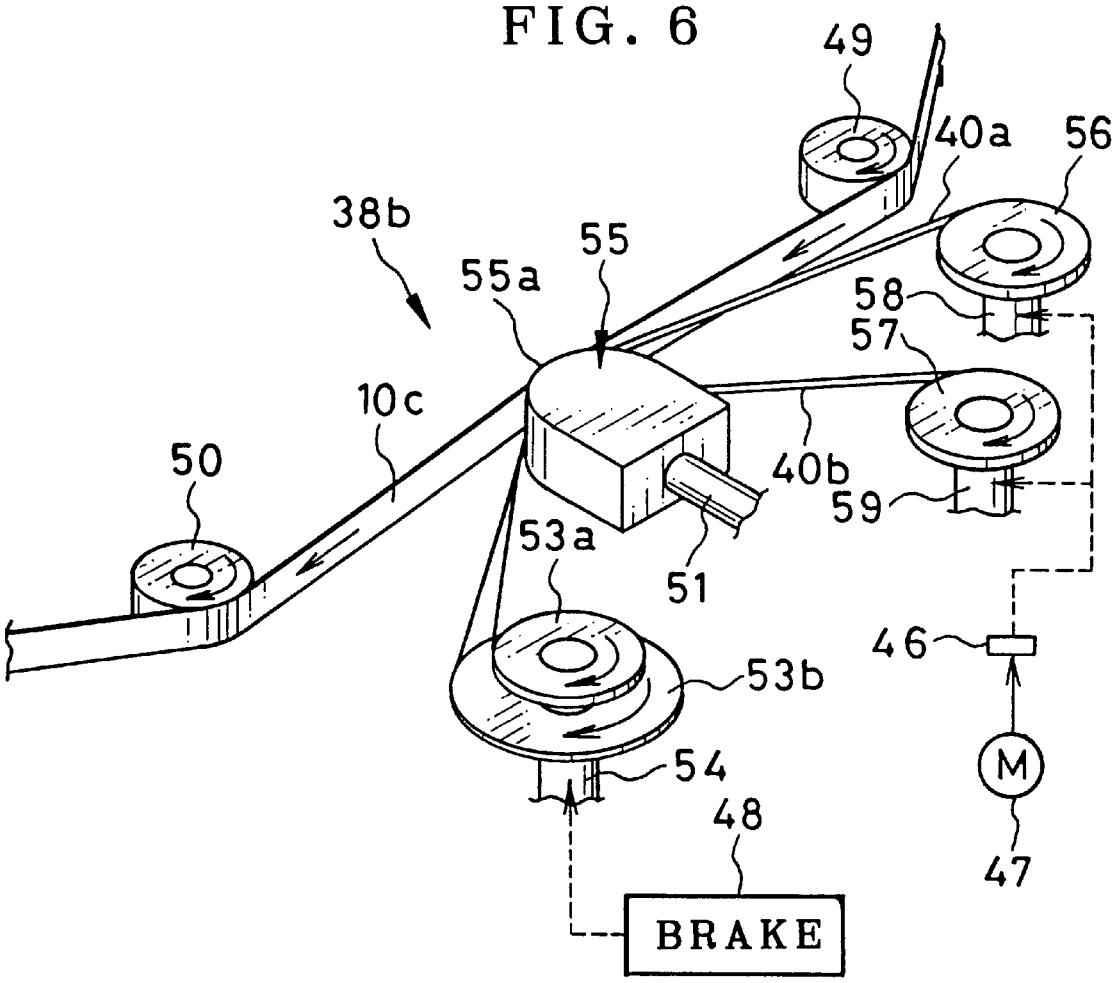
FIG. 6 is a perspective view of a second type cleaning device according to another embodiment of the invention, for cleaning side portions of a surface of the photo film.

The emulsion surface 12 can be cleaned up by use of the same type cleaning device 38*a* as shown in FIG. 4. However, as the emulsion layer surface 12 is to record image frames, it is very important not to scratch the frame recording area of the emulsion surface 12. To ensure protection against the scratches on the frame recording area by the cleaning, a second type cleaning device 38*b* as shown in FIG. 6 is preferable, which cleans side portions of the emulsion surface 12 outside the frame recording area.

This cleaning device 38*b* uses a pair of cleaning tapes 40*a* and 40*b* having a width corresponding to the side portion of the emulsion surface. The cleaning tapes 40*a* and 40*b* are wound around reels 53*a* and 53*b* which are coaxially fit on a driven shaft 54, and are spaced in the axial direction. After passing a cleaning head 55, the cleaning tapes 40*a* and 40*b* are taken up by reels 56 and 57 which are fit on different drive shafts 58 and 59, respectively. The drive shafts 58 and 59 are rotated by a motor 47 through a speed reduction device 46. The filmstrip 10*c* is transported in a direction through guide rollers 49 and 50, while the cleaning tapes 40*a* and 40*b* are transported in the opposite direction.

Figure 7:
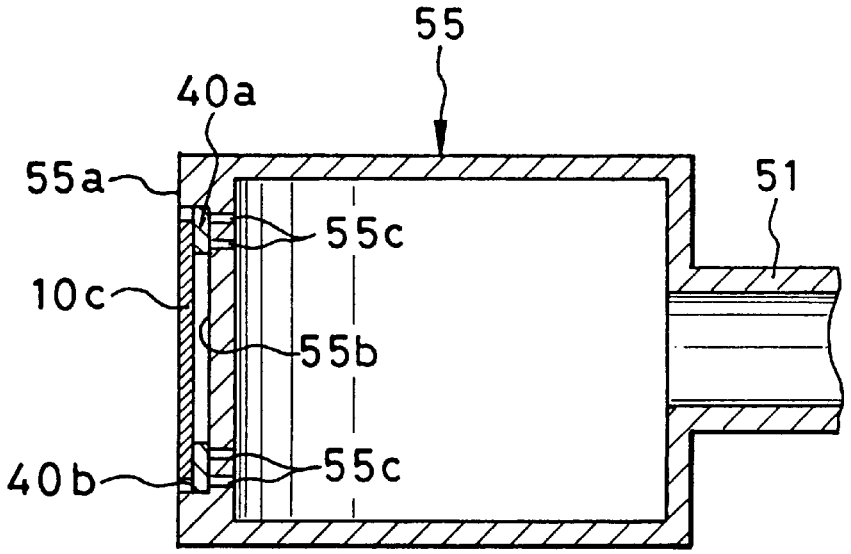
FIG. 7 is a sectional view of a cleaning head of the second type cleaning device.

As shown in FIG. 7, the cleaning head 55 has a convex face surface 55*a* which is formed with a stepped recession 55*b* whose length in a crosswise direction of the filmstrip 10*c* is slightly more than the width of the filmstrip 10*c*. The cleaning tapes 40*a* and 40*b* are guided along opposite stepped edges of the recession 55*b*, while the filmstrip 10*c* is guided such that the side portions of the filmstrip 10*c* slide on the cleaning tapes 40*a* and 40*b*. In this way, the cleaning tapes 40*a* and 40*b* do not contact the frame recording area of the filmstrip 10*c*.

To suck up the dust into the cleaning tapes 40*a* and 40*b*, suction holes 55*c* are preferably formed through those zones of the recession 55*b* on which the cleaning tapes 40*a* and 40*b* slide, so that the frame recording area of the filmstrip 10*c* may not contact the cleaning head 55.

Figure 8:
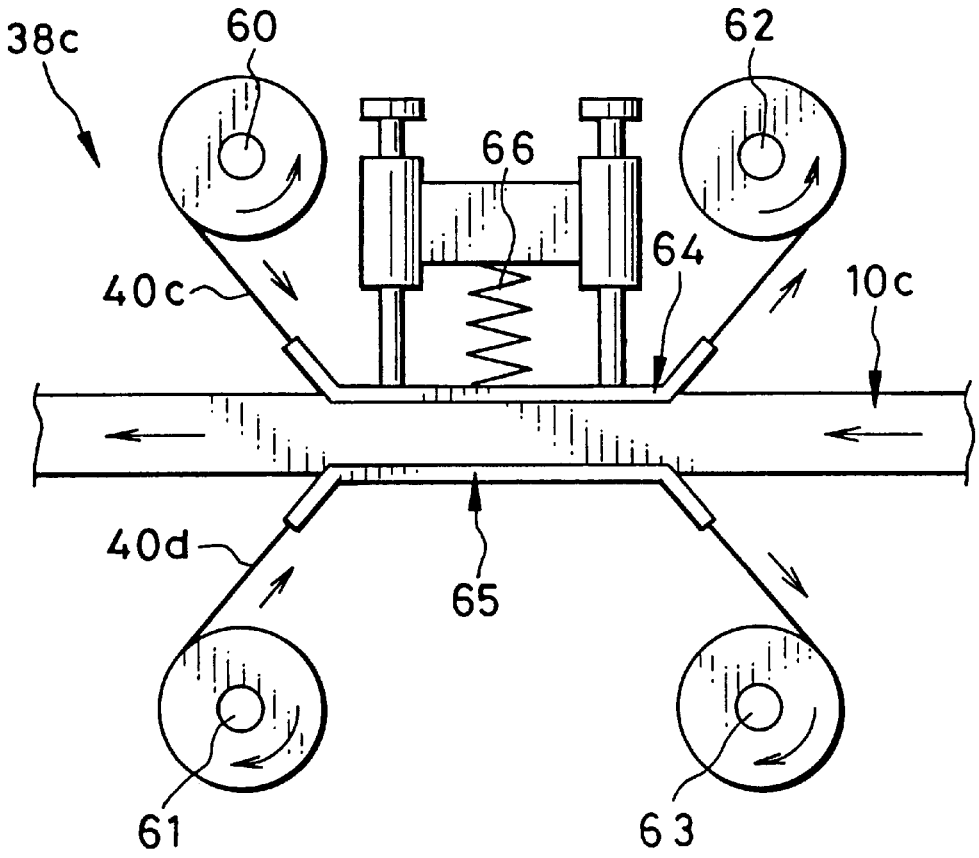
FIG. 8 is an explanatory top plan view of a third type cleaning device according to a further embodiment of the invention, for cleaning side edges of the photo film.
Figure 9:
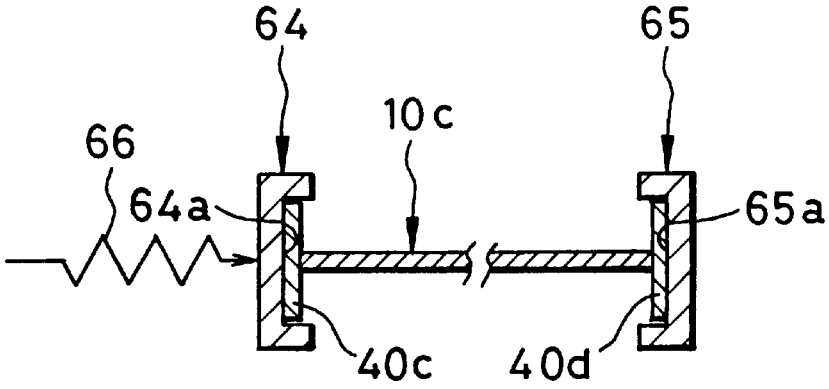
FIG. 9 is a sectional view of essential parts of the third type cleaning device.

FIG. 8 shows a third type cleaning device 38*c* that cleans the side edges of the filmstrip 10*c*, wherein a pair of cleaning tapes 40*c* and 40*d* are transported along the side edges of the filmstrip 10*c* from supply reels 60 and 61 to take-up reels 62 and 63, respectively. As shown in FIG. 9, a pair of guide rails 64 and 65 are disposed along the opposite lateral sides of the filmstrip 10*c*, to guide the cleaning tapes 40*c* and 40*d* such that the tapes 40*c* and 40*d* are oriented vertically to the filmstrip 10*c*, and are pressed onto the side edges of the filmstrip 10*c*. The guide rails 64 and 65 have a channel 64*a* or 65*a*, and the cleaning tape 40*c* or 40*d* slides along the channel 64*a* or 65*a* of the guide rail 64 or 65, respectively.

The filmstrip 10*c* can remove from either of the cleaning tapes 40*c* and 40*d* for some reasons such as curling. To ensure the contact between the cleaning tapes 40*c* and 40*d* and the side edges of the filmstrip 10*c*, one guide rail 64 is mounted to be movable in the crosswise direction of the filmstrip 10*c*, and is urged by a spring 66 toward the other guide rail 65, whereas the other guide rail 65 is mounted stationary. It is desirable to make the force of the spring 66 adjustable.

The guide rails 64 and 65 may have suction holes. It is possible to use a pair of cleaning heads having the same construction as shown in FIG. 5 in place of the guide rails 64 and 65. It is also possible to replace either of the guide rails 64 and 65 by a pair of guide rollers spaced from each other along the side edge. It is possible to omit the suction holes 43*b* or 55*c* from the cleaning head 43 or 55.

Figure 10:
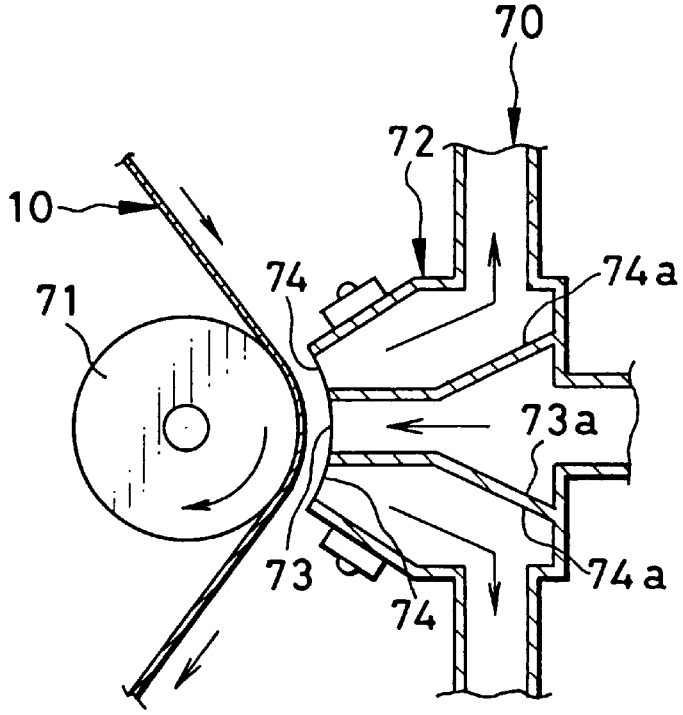
FIG. 10 is a sectional view of a non-contact cleaning device according to still another embodiment of the invention.

Instead of the above cleaning device 38*a* or 38*b* using cleaning tapes, an air cleaning device 70 as shown in FIG. 10 may be used for cleaning either the emulsion surface 12 or the magnetic layer surface 13.

The air cleaning device 70 is opposed to a feed roller 71 to transport the photo film in the lengthwise direction. The air cleaning device 70 has a casing 72 having an air nozzle 73 and a pair of suction mouths 74 therein. The casing 72 extends over a part of the photo film 10 that is contacting the feed roller 71. Clean air is conducted from the exterior through a duct 73*a* into the air nozzle 73, to blow the dust off the photo film 10. The air nozzle 73 is sized such that the blowing air covers the entire width of the photo film 10.

The suction mouths 74 are provided on opposite sides of the air nozzle 73, that is, before and behind the air nozzle 73 in the film transporting direction 10. Through the suction mouths 74, the dust blown off the photo film 10 is sucked into suction ducts 74*a*, and ejected to the outside.

The casing 72 is mounted to be movable to adjust the distance to the photo film 10. The distance from the photo film 10 to the air nozzle 73 and the suction mouths 74 is set to be as small as possible, e.g., not more than 0.5 mm. Rotational speed of the feed roller 71 is adjusted to the transporting speed of the photo film 10. The air nozzle 73 may jet ionic air. The non-contact air cleaning is preferable, because there is no danger of scratching the photo film 10.

Figure 11:
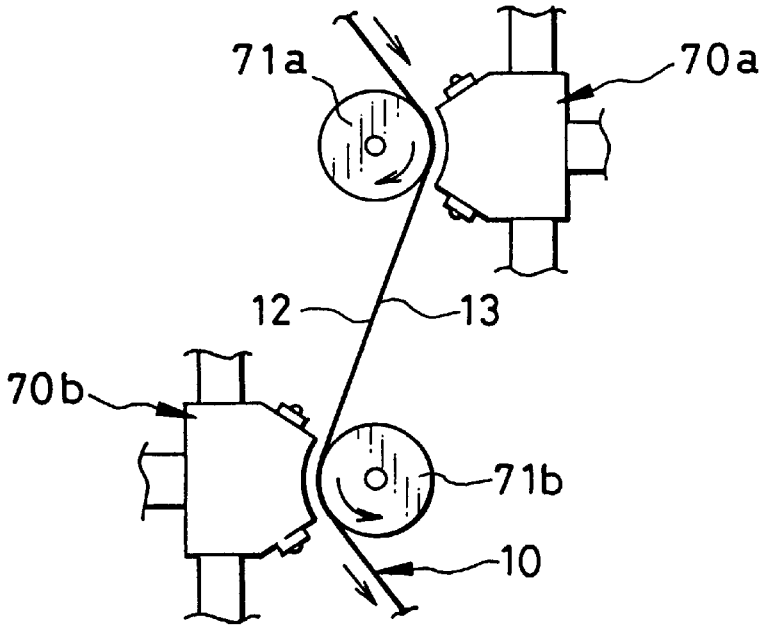
FIG. 11 is an explanatory view of a cleaning process using the non-contact cleaning devices for both surfaces of the photo film.

FIG. 11 shows an embodiment wherein a pair of air cleaning devices 70*a* and 70*b* having the same construction as shown in FIG. 10 are provided for cleaning the both surfaces 12 and 13 of the photo film 10. The air cleaning devices 70*a* and 70*b* are respectively opposed to feed rollers

71*a* and 71*b* which are spaced in the film transporting direction from each other, and are in contact with the opposite surfaces of the photo film 10, respectively. According to this embodiment, the air cleaning device 70*a* is to blow the dust off the magnetic layer surface 13, whereas the air cleaning device 70*b* is to blow the dust off the emulsion surface 12. Since the air cleaning device 70*b* is disposed downstream of the air cleaning device 70*a*, the emulsion surface 12 is cleaned up later than the magnetic layer surface 13. Thus, the cleaning of the emulsion surface 12, whose quality is most important for the photo film 10, is ensured.

Although the present invention has been described with respect to photo film with transparent magnetic layer, the cleaning method and apparatus of the present invention are applicable to those photo film having no magnetic layer.

Thus, the present invention should not be limited to the above described embodiments but, on the contrary, various modification may be possible to those skilled in the art without departing from the scope of claims attached hereto.

What is claimed is:

1. An apparatus for cleaning a web of photo film comprising:

a transporting device for transporting the web of photo film in a lengthwise direction thereof;

a second transporting device for transporting a pair of opposing cleaning tapes in a direction parallel to the lengthwise direction of the photo film; and a device for pushing inward at least one of said cleaning tapes for creating contact between said pair of opposing cleaning tapes and both side edges of the photo film.

2. An apparatus as claimed in claim 1, wherein the second transporting device transports the cleaning tapes in the opposite direction to the photo film.

3. An apparatus as claimed in claim 1, further comprising a pair of opposing guide members for guiding the cleaning tapes in an orientation vertical to the photo film.

4. An apparatus as claimed in claim 3, wherein each of said guide members comprises a channel for receiving said cleaning tape.

5. An apparatus as claimed in claim 3, wherein at least one of said cleaning tapes is pushed inward by a spring contacting at least one of said guide members.

6. An apparatus as claimed in claim 5, wherein said spring is adjustable.

7. An apparatus as claimed in claim 3, wherein at least one of said guide members remains stationary.

* * * * *